United States Patent [19]

Sevelinge

[11] Patent Number: 4,682,739

[45] Date of Patent: Jul. 28, 1987

[54] DEVICE FOR PROJECTING SOLID PARTICLES FOR A VACUUM CENTRIFUGAL GRINDER

[75] Inventor: Gérard Sevelinge, Montceau les Mines, France

[73] Assignee: Framatome, Courbevoie, France

[21] Appl. No.: 827,586

[22] Filed: Feb. 10, 1986

[30] Foreign Application Priority Data

Feb. 15, 1985 [FR] France ..... 85 02234

[51] Int. Cl.[4] ..... B02C 19/00

[52] U.S. Cl. ..... 241/275

[58] Field of Search ..... 241/275, 300, 301, DIG. 14, 241/291; 198/641, 642

[56] References Cited

U.S. PATENT DOCUMENTS

| | | | |
|---|---|---|---|
| 3,174,697 | 3/1965 | Bridgewater . | |
| 4,138,067 | 2/1979 | Planiol | 241/275 |
| 4,575,014 | 3/1986 | Szalanski et al. | 241/275 |
| 4,577,806 | 3/1986 | Terrenzio | 241/275 |

FOREIGN PATENT DOCUMENTS

| | | | |
|---|---|---|---|
| 2201928 | 5/1974 | France . | |
| 2412348 | 7/1979 | France . | |
| 1434420 | 5/1976 | United Kingdom | 241/275 |

*Primary Examiner*—Mark Rosenbaum

*Attorney, Agent, or Firm*—Pollock, Vande Sande & Priddy

[57] ABSTRACT

Device for projecting solid particles for a vacuum centrifugal grinder incorporating a rotationally driven distributor wheel (20) in which a plurality of ejection channels are formed. The particle-guiding face in each channel (21, 22) has a curvature (A) extending in the direction of rotation of the distributor wheel (20) and whose outline, calculated as a function of the friction coefficients of the materials in contact, produces the attachment to said curvature (A) of a stable self-protection layer (30) consisting of the particles themselves, with automatic regeneration of the layer as it wears. The invention applies, for example, to the grinding of cement or pulverized coal.

3 Claims, 3 Drawing Figures

DEVICE FOR PROJECTING SOLID PARTICLES FOR A VACUUM CENTRIFUGAL GRINDER

FIELD OF THE INVENTION

The present invention relates to a device for projecting solid particles for a vacuum grinder, in which the particles to be ground are projected by centrifugal force onto an impact surface arranged inside an evacuated enclosure.

BACKGROUND OF THE INVENTION

It is known that this type of grinder makes use of centrifugal force to project the substances to be ground onto targets at very high speeds, the whole device being placed under vacuum to avoid the braking of the projected particles by air resistance.

A vacuum grinder incorporates a closed, pressure-resistant enclosure which is evacuated and in the upper part of which is placed a distributor wheel driven in rotation at a high speed.

The wheel is equipped on its axis with a central feed chamber equipped in its upper part with an axial orifice arranged at the bottom of a hopper fed with the substance to be ground by means of a metering device, for example a screw feeder, placed at the outlet of a feed chamber acting as an airlock and enabling the substance to be introduced into the evacuated enclosure.

The distributor wheel is furthermore equipped with a plurality of projection channels whose axes are centered in a median plane perpendicular to the axis and which open inwards into the feed chamber and outwards on to the periphery of the wheel. The substance introduced by the metering device into the central feed chamber is thus entrained by centrifugal action into the channels and projected at the outlet of the latter onto an assembly of plates forming targets and placed all around the wheel, along the side wall of the enclosure. The lower part of the latter is in the shape of a hopper and recovers the fine powder produced by the shattering of the particles of substance which are projected in this way onto the targets by the channels in the wheel.

When the distributor wheel rotates at a sufficient speed, a radial and tangential acceleration is thus produced within the channels, enabling the required velocity to be obtained at the outlet. A contact action between the particles and the wheel, which depends on the speed of rotation, and, consequently, a channel wear phenomenon, is thus produced with these channels, particularly at the outlet of the wheel. This abrasion phenomenon depends on the physical properties of the particles, but is always very considerable as soon as the ejection velocity becomes considerable itself, in view of the high value of the effect of contact between the particles and the wheel and of the relative displacement velocity of the particles in the channels.

Until now, the protective means employed, and particularly the surface treatments, have not made it possible to make the distributor wheel sufficiently resistant, and it is therefore necessary to change the distributor wheel fairly frequently, which is obviously costly, since each wheel has to be made and machined with high accuracy because of its very high rotational speed, which subjects it to high stress. Furthermore, to carry out these operations it is necessary to stop the grinder, which is incompatible with industrial operation in the fields in which continuous production is required, such as cement manufacture or ore grinding.

SUMMARY OF THE INVENTION

The subject of the invention is an improved grinder wheel which enables these disadvantages to be remedied, by reducing the displacement speed of the particles in the projection channels, while retaining the same ejection velocity.

According to the invention, the face for guiding the particles in each channel has a positive curvature, i.e., a curvature extending in the direction of rotation of the distributor wheel, and whose outline, judiciously calculated as a function of the friction coefficients of the materials in contact, produces the attachment to this curvature of a stable self-protective layer consisting of the particles themselves, with automatic regeneration of the said layer as it wears.

BRIEF DESCRIPTION OF THE DRAWINGS

The invention will be understood better with the aid of the following description of an embodiment, with reference to the attached drawings, in which.

DETAILED DESCRIPTION

Figure 1:
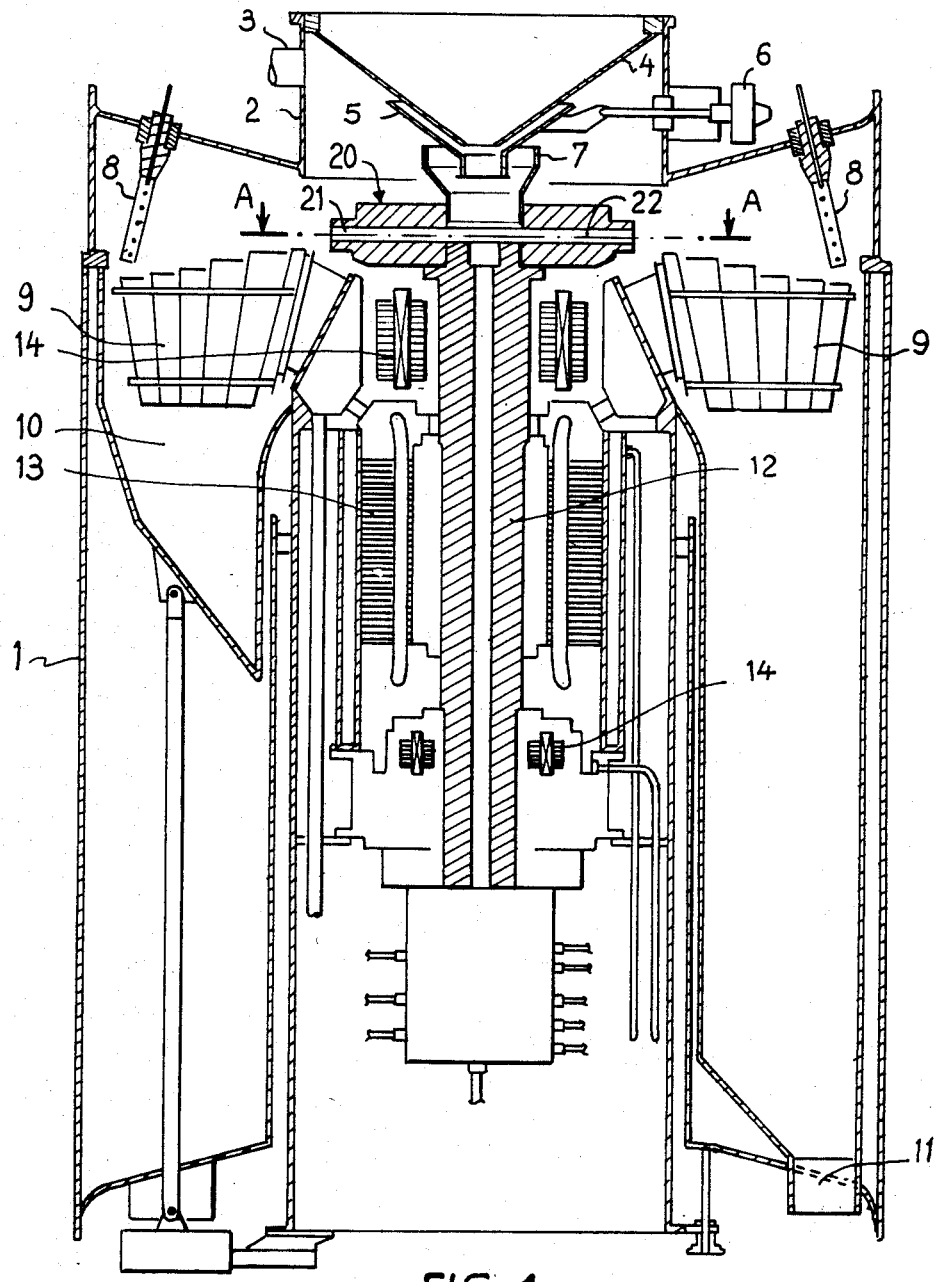
FIG. 1 is a diagrammatic view in vertical cross-section of the whole of a grinder employing a distributor wheel to the invention.

FIG. 1 shows a cylindrical enclosure 1 with a vertical axis, in the upper part of which is arranged a vertical duct 2 of large cross-section, which has a side branch, fixed to which is a duct 3 connected to a vacuum (not shown). Hoppers 4 and 5 are arranged inside the duct 2. Hopper 5 is connected to a vibrator 6.

Below the vibrating hopper 5 there is arranged a hopper 7 fixed integrally to a wheel 20 forming the upper part of the rotor. This wheel is pierced by several uniformly spaced channels in a radial direction, such as 21 and 22.

A target 8, the impact surface of which is covered with a wear- and impact-resistance material, is arranged in the extension of these channels and all around the enclosure.

A volume of space into which the particles to be ground will be projected can be determined between the outer peripheral surface of the wheel 20 and the target 8. Below this volume of space are arranged deflectors 9 fixed to a hopper 10 which can vibrate, the function of which is to collect the ground powdered material to direct it towards the outlet 11, connected to a set of vacuum locks enabling the product to flow without breaking the vacuum in the enclosure.

The wheel 20 forming the upper part of the grinder rotor is integrally fixed to an elongated cylindrical tubular shaft 12. This shaft 12, driven by a motor 13, is guided and supported by a set of bearings and abutments 14.

The motor 13 enables the wheel 20 to be driven in rotation at very high speeds.

Figure 2:
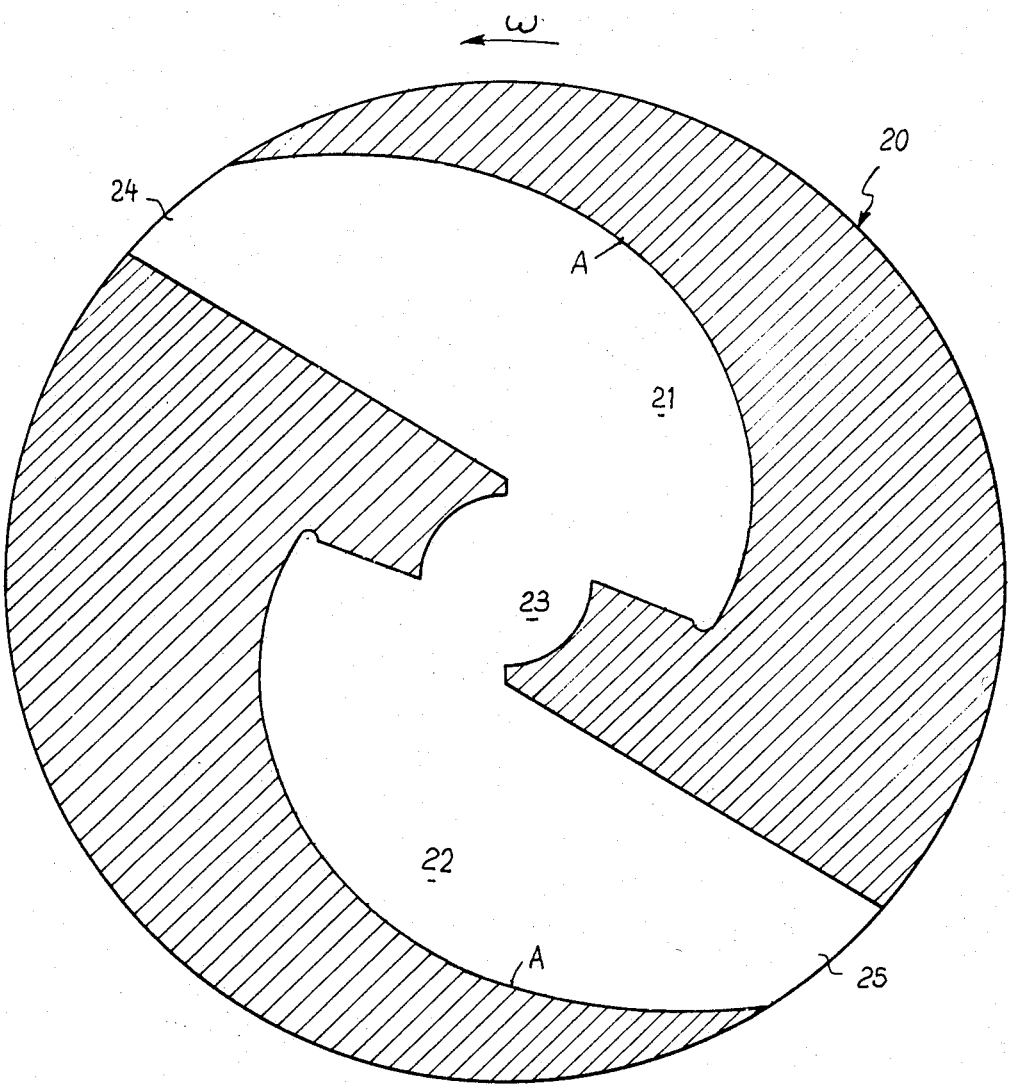
FIG. 2 is a view in cross-section along line A—A of FIG. 1.

FIG. 2 shows on a larger scale the distributor wheel 20, inside which there are provided a feed chamber 23 and two channels 21 and 22 opening at their ends inwards into the feed chamber 23 and outwards onto the periphery of the wheel via discharge orifices 24 and 25.

The granular material enters the feed chamber 23 and is projected outwards by centrifugal action, while passing through the channels 21 and 22. The particles which are thus projected by the channels hit the target 8 and are reduced to a fine powder.

Since granular materials, for example cement or pulverized coal, which are treated in centrifugal grinders, are fairly abrasive, fairly rapid wear of the inner side wall of the projection channels, and particularly of the peripheral outlet orifice, has been observed until now in grinders of this type.

The invention makes it possible to avoid this wear phenomenon, by giving the distribution channels a particular and determined curvature.

For this purpose, the rubbing face of each channel, onto which face the particles are projected, has a positive curvature A, i.e., a curvature which extends in the direction of rotation of the distributor wheel 20.

This curvature A, the outline of which is judiciously calculated as a function of the friction coefficience of the materials in contact, i.e., as a function of the material of which the distributor wheel is made and of the particles to be projected, permits the attachement to this curvature A of a stable layer 30 (FIG. 3) formed by the particles themselves, thus producing an efficient protection of the distributor wheel.

Figure 3:
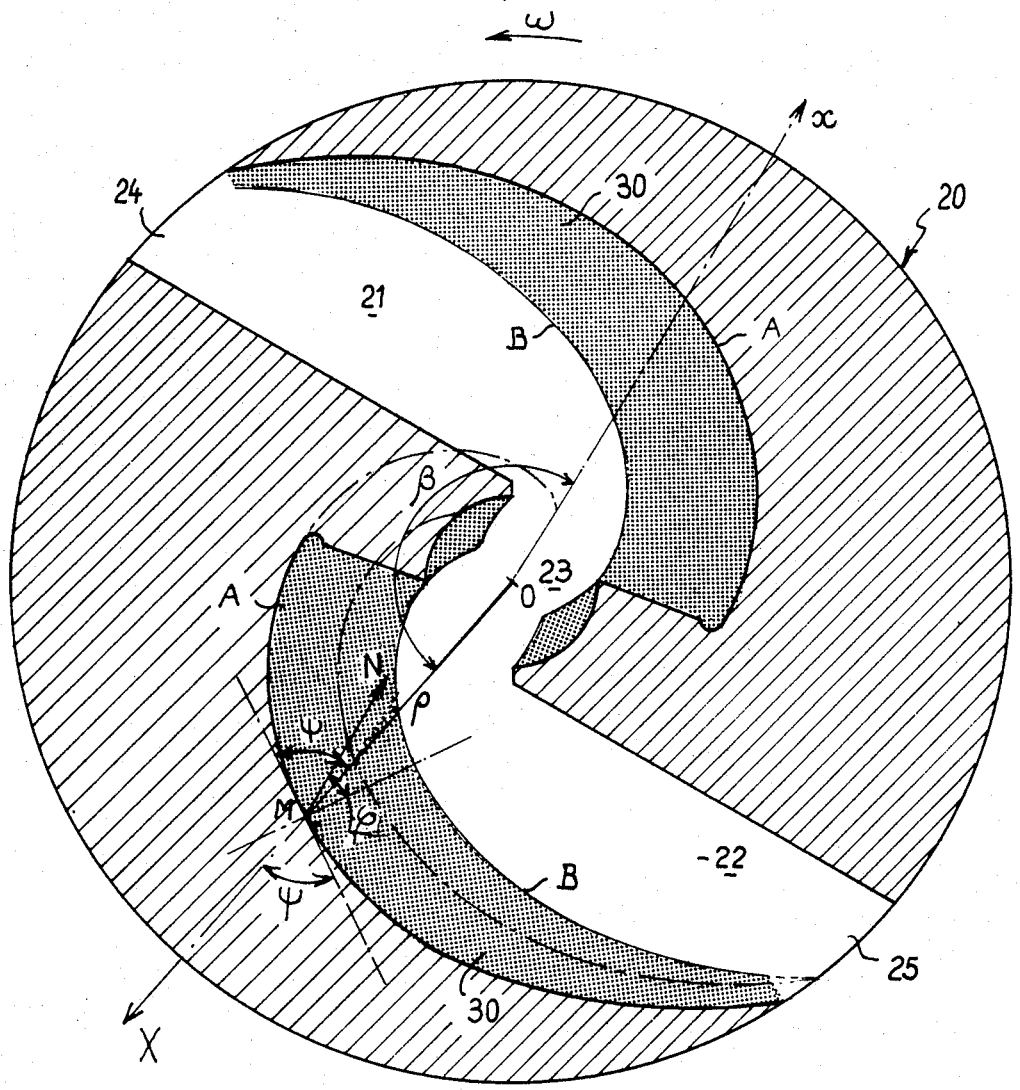
FIG. 3 is a view identical to FIG. 2, showing the trajectory followed by the particles in the distributor wheel during the operation of the grinder.

With reference to FIG. 3, the determination of the curvature A forming the bearing face of each channel is carried out as follows:

When considering a particle at a point M, a point of contact between the said particle and the bearing face of the channel, it can be seen that the contact force N at this point M may be directed along the vector radius OX if:

$$\Psi+\phi=\pi/2.$$

$\Psi$ being the angle formed by the tangent to curve and the vector radius at the point M in question, $\phi$ being the angle whose tangent is equal to the friction coefficient, and hence dependent on the materials in contact.

For any curvature defined mathematically in polar coordinates, we have:

$$tg\,\Psi=\frac{\rho}{d\rho/d\beta}$$

in which:

$\rho$=radius at the given point M, $\rho=f(\beta)$=function of angle $\beta$ $\beta$ being the angle between the axis of origin and the vector radius at point M.

When the equation of the curvature is known, it is then possible to calculate tan $\Psi$ for each of its points.

Consequently, when $\Psi+\phi=\pi/2=90°$, the contact force N passes through O, the center of the distributor wheel on the axis of rotation. In this case, any particle placed at a point M, which has a coefficient of friction with the material of the wheel which is equal to tan $\phi$, remains motionless. There is therefore a curvature, which may be called a "limiting arrest curve", such that at each point $\Psi+\phi=\pi/2$ applies, a curve on which the particles remain motionless.

Thus, channels 21 and 22 are made in the distributor wheel 20, with their bearing or rubbing face following the curve A in order that $\Psi+\phi\geqq\pi/2$ applies at any point, so that any particle arriving at the face of the channel which follows this curve will be stopped.

Consequently a packing 30 of particles will be produced until this packing describes a curve B (FIG. 3) such that, for this curve $\phi+\phi\leqq\pi/2$.

By these means, a layer of motionless films the thickness of which is a function of the curves A and B will thus be maintained on the rubbing face of each channel. This fixed layer therefore forms a real protection of the distributor wheel.

After formation of this protective layer, i.e., after having reached the curve B, the particles delivered by the feed chamber 23 in the distributor wheel 20 will begin to move and slip over the cushion of the particles trapped between the curves A and B, with automatic regeneration of the cushion at the same time as its wear and ejection of the particles at the required velocity via the orifices 24 and 25.

When the characteristics of the material to be projected and those of the material of which the distributor wheel is made are known, it is easily possible to determine the friction coefficient of the particles with the material chosen for making the wheel. Similarly, when the coefficient of friction over itself of the material to be projected is known, the limiting curve B can be readily predicted.

In the case where the coefficient of friction on itself of the material to be projected is higher than the coefficient of friction of the material to be projected on the material of which the wheel is made, it is the center of gravity of the protective film which will need to lie on a curve such as $\Psi+\phi\geqq90°$ The bottom of the channel, the face to which this film is attached, will consequently have to be calculated.

Depending on the nature of the product to be projected and on the particle size of the product which it is intended to obtain, the distributor wheel 20 needs to rotate at a higher or lower speed. However, the formation of a protective cushion will be obtained in every case, because the covering of the particles is independent of the speed of rotation of the wheel.

Self protection of the channels by the product itself is thus produced, which avoids any abrasion while maintaining a sufficient speed of rotation of the distributor wheel to produce the required particle size.

Instead of using a substantially flat or disc-shaped wheel, it is also possible to use, for example, a hemispherical bowl, but the principle of the form of the channels remains unaltered to produce the attachment of a film of particles to be projected which serves as a protective layer for the channels and avoids abrasion by the particles. Furthermore, the number of ejection channels depends on the throughput to be produced and on the diameter of the distributor wheel.

I claim:

1. Device for projecting solid particles for a vacuum centrifugal grinder, comprising a rotationally driven distributor wheel (20) for projecting at a high speed onto a target (8) a granular material introduced into a central feed chamber (23) placed on the axis of the said wheel, a plurality of channels (21, 22) being arranged within the wheel at right angles to its axis and opening outwards via ejection orifices (24, 25) onto the periphery of the wheel, producing the attachment of a single, uninterrupted stable self-protective layer (30) formed by the particles themselves over the entire length of said channel, wherein the face for guiding the particles in each channel (21, 22) has a curvature (A) extending in the direction of rotation of the distributor wheel (20), and whose outline is calculated as a function of the friction coefficients of the materials in contact, and is determined so that the following formula $$\Psi+\phi \geqq (\pi/2)$$

where $\Psi$ determines the angle formed by the tangent to the curve and the vector radius at the point in question, and $\phi$ determines the angle whose tangent is equal to the friction coefficient, applies to any point of said curvature.

2. Device according to claim 1, wherein the stable self-protective layer (30) formed by the particles themselves is regenerated as it wears.

3. Device according to claim 1 or 2, wherein within each channel (21, 22) the stable self-protective layer (30) forms a particle slip surface between the central feed chamber (23) and the ejection orifices (24, 25), following a limiting curvature B such that $\Psi+\phi \leqq (\pi/2)$ applies.

* * * * *